US005540510A

United States Patent [19]

Sims et al.

[11] Patent Number: 5,540,510

[45] Date of Patent: Jul. 30, 1996

[54] PRINTING DEVICE FOR RECEIVING AT LEAST TWO DIFFERENT TYPES OF TAPE HOLDING CASES

[75] Inventors: Charles R. Sims, Royston; Robert C. L. Day, Cambridge, both of United Kingdom

[73] Assignee: Esselte Dymo N.V., St. Niklaas, Belgium

[21] Appl. No.: 266,818

[22] Filed: Jun. 27, 1994

[30] Foreign Application Priority Data

Jul. 12, 1993 [GB] United Kingdom ..... 9314387

[51] Int. Cl.[6] ..... B41J 35/28

[52] U.S. Cl. ..... 400/208; 400/613

[58] Field of Search ..... 400/207, 208, 400/208.1, 613, 692, 703, 708, 663, 664; 347/214

[56] References Cited

U.S. PATENT DOCUMENTS

| | | | |
|---|---|---|---|
| 4,924,242 | 5/1990 | Fukawa | 400/208 |
| 5,104,247 | 4/1992 | Ohshima | 400/240.3 |
| 5,253,334 | 10/1993 | Kimura et al. | 400/586 |
| 5,333,959 | 8/1994 | Yamaguchi et al. | 400/613 |

FOREIGN PATENT DOCUMENTS

| | | | |
|---|---|---|---|
| 0234304A1 | 9/1987 | European Pat. Off. . | |
| 0260111 | 3/1988 | European Pat. Off. . | |
| 0497352A3 | 8/1992 | European Pat. Off. . | |
| 0526078A3 | 2/1993 | European Pat. Off. . | |
| 4022696A1 | 1/1991 | Germany . | |
| 59-93376 | 5/1984 | Japan . | |
| 59-222380 | 12/1984 | Japan | 400/207 E |
| 62-292474 | 12/1987 | Japan | 400/207 E |

*Primary Examiner*—David A. Wiecking
*Attorney, Agent, or Firm*—Pennie & Edmonds

[57] ABSTRACT

A printing device has a simple mechanism for ensuring that a cassette having tape of a proper width is inserted into it for printing and for advising a microprocessor of the width of the tape. This is achieved by providing a switch with an actuating part which can be accommodated by a cassette of one type but not by a cassette of a different type.

9 Claims, 2 Drawing Sheets

PRINTING DEVICE FOR RECEIVING AT LEAST TWO DIFFERENT TYPES OF TAPE HOLDING CASES

FIELD OF THE INVENTION

The present invention relates to a printing apparatus and is particularly concerned with thermal printing apparatus which receive tape holding cases housing a tape to be printed.

BACKGROUND OF THE INVENTION

Printing apparatus of the general type with which the present invention is concerned are known. They operate with a supply of tape arranged to receive an image and a means for transferring the image onto the tape. In one known device, there is a tape holding case which holds a supply of image receiving tape and a supply of an image transfer ribbon, the image receiving tape and the transfer ribbon being passed in overlap through a printing zone of the printing device. At the print zone, a thermal print head cooperates with a platen to transfer an image from the transfer ribbon to the tape. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releasable backing layer by a layer of adhesive.

The upper layer can either receive an image on its top surface, its lower surface being secured to the releaseable backing layer by a layer of adhesive or alternatively the upper layer can be transparent and can receive an image on one of its faces printed as a mirror image so that it is viewed the correct way round through the other surface of the tape. In this case, a double sided adhesive layer can be secured to the upper layer, this double sided adhesive layer having a releaseable backing layer. This latter arrangement is described for example in EP-A-0322918 (Brother Kogyo Kabushiki Kaisha).

In another type of printing device (described for example in our European Application No. EP-A-0573187, there are two separate tape holding cases, one holding image receiving tape and the other holding an image transfer ribbon.

With all such printing devices it is desirable that they are able to operate with image receiving tapes of different widths. For this, the apparatus should include a way of identifying the width of tape within the tape holding case so that printing can be correctly carried out or inhibited where an incorrect tape is inserted. For example if tape of a narrower width is used, printing should be confined to the area of the narrow width tape and should not extend to a width suitable for a wider tape.

There have been various proposals made to identify the width of tape within a tape holding case. In U.S. Pat. No. 5,078,523 (Varitronics, Inc.), an electrical sensing arrangement is used responsive to different resistive values. Each tape holding case holds a tape of a predetermined width and has a resistor of a predetermined resistive value associated with that width. On insertion of the tape holding case into the printing apparatus, the resistive value is sensed and the width of tape within the tape holding case is thereby identified.

In EP-A-0497352 (Casio), tape holding cases having tapes of different widths are arranged to actuate different micro-switches when inserted into the printing device. Thus, the width of tape is identified by a variation in the external casing of the tape holding case.

In EP-A-0526078 (Brother), the shape of a tape holding case interacts with an optical sensor to identify the width of tape therein.

The present invention seeks to provide a different solution to the problem of identification of different tape widths within a tape holding case, which is cheaper and simpler than the above mentioned solutions and which enables a user to positively set the tape width which he requires.

SUMMARY OF THE INVENTION

According to the present invention there is provided a printing device comprising a zone for receiving a tape holding case which houses tape for printing, and a switch movable between at least first and second positions, wherein in the first position a tape holding case of a first type may be inserted into said zone but a tape holding case of a second type may not be inserted into said zone and in the second position a tape holding case of the second type may be inserted into said zone but a tape holding case of the first type may not be inserted into said zone.

Preferably, the zone comprises a cassette receiving bay having a surface for receiving a tape holding case. In the described embodiment, that surface is provided with a slot and the switch has an actuating part which extends through the slot and above the surface of the cassette receiving bay. A tape holding case of the first type holds tape of a first width and is provided with a recess in a location which will receive the actuating part of the switch when the switch is in the first position. The tape holding case of the second type holds tape of a second width and is provided with a recess in a location which will receive the actuating part of the switch when it is in the second position. It will readily be appreciated that in other respects the tape holding cases are the same so that the external boundaries of the tape holding cases lie on a common perimeter defined by the cassette receiving bay.

Before use, a user moves the actuating part of the switch into the position representing the tape width which he desires to use and then inserts the appropriate tape holding case. If an attempt is made to insert an incorrect tape holding case, this attempt will be foiled because the actuating part of the switch will prevent the tape holding case from being inserted.

The switch is preferably connected to a microprocessor of the printing device to automatically advise the microprocessor of the width of tape which has been selected.

For a better understanding of the present invention, and to show how the same may be carried into effect, reference will now be made by way of example to the accompanying drawings.

DESCRIPTION OF THE PREFERRED EMBODIMENT

Figure 1:
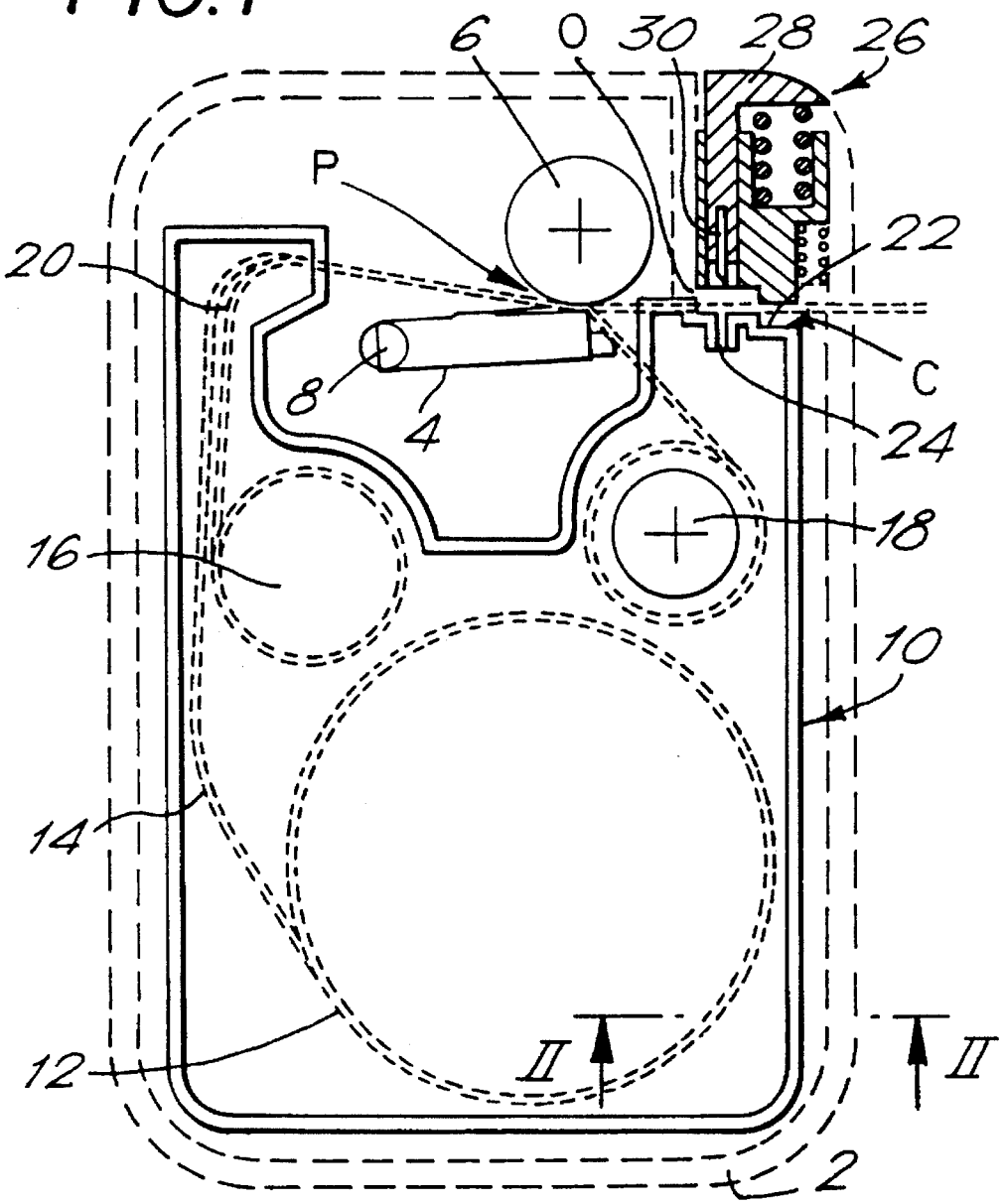
FIG. 1 shows in diagrammatic plan view a printing device with a cassette inserted therein.

FIG. 1 illustrates in plan view a cassette bay of a printing device. The cassette bay is shown by the dotted line 2. The cassette bay includes a thermal print head 4 and a platen 6 which cooperate to define a print location P in a manner which is known in the art. The print head 4 is pivotable about a pivot point 8 so that it can be brought into contact with the platen 6 for printing and moved away from the platen to enable a cassette to be removed and replaced.

A cassette inserted into the cassette bay 2 is denoted generally by reference numeral 10. The cassette holds a supply spool 12 of image receiving tape 14 which comprises an image receiving layer secured to a backing layer by a layer of adhesive. The image receiving tape 14 is guided by a guide mechanism (which is not shown) through the cassette, out of the cassette through an outlet O, past the print location P to a cutting location C. The cassette 10 also has an ink ribbon supply spool 16 and an ink ribbon take up spool 18. The ink ribbon 20 is guided from the ink ribbon supply spool 16 through the print location P and taken up on the ink ribbon take up spool 18. The image receiving tape 14 passes in overlap with the ink ribbon 20 through the print location P with its image receiving layer in contact with the ink ribbon.

In the printing device illustrated in FIG. 1, the platen 6 is driven so that it rotates to drive the image receiving tape 14 past the print location P during printing. In this way, tape is printed and fed out from the print location P to the cutting location C. The portion of the wall of the cassette 10 where the cutting location C is defined is denoted by reference numeral 22. A slot 24 is defined in this wall portion and the image receiving tape 14 is fed past the print location P to the cutting location C.

The printing device includes a cutting mechanism denoted generally by reference numeral 26. This cutting mechanism includes a cutter support member 28 which carries a blade 30. The blade 30 cuts the image receiving tape 14 and then enters the slot 24 with the leading part of its edge 31 first, rather than bearing against an anvil. The detailed operation of the cutting mechanism is described in U.S. application Ser. No. 266,828 filed Jun. 27, 1994, the contents of which are herein incorporated by reference.

Figure 2:
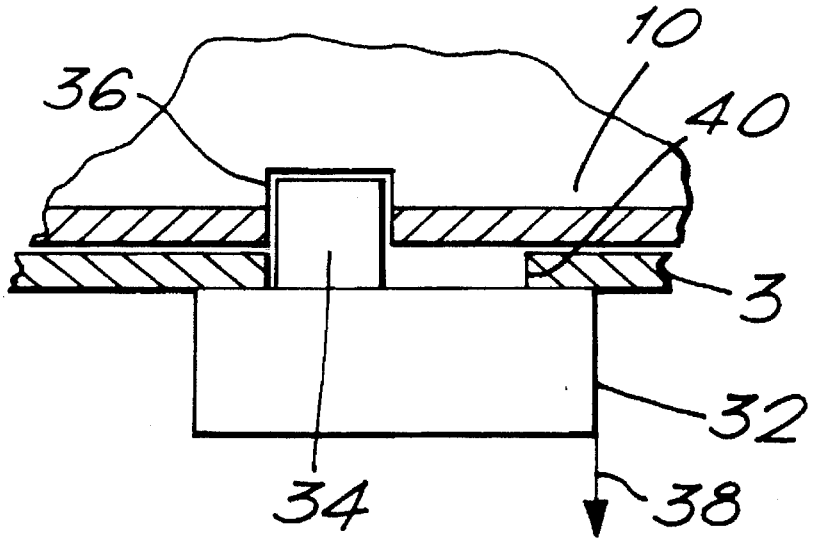
FIGS. 2 and 3 are partial sections along line II—II illustrating a tape width selection switch.

FIG. 2 shows a partial diagrammatic section along the line II—II in FIG. 1. In FIG. 2, reference numeral 3 denotes the floor of the cassette bay 2. Reference numeral 10 again denotes a cassette of a first type, for example holding an image receiving tape 14 having a first width of 12 mm. Reference numeral 32 denotes a switch and reference numeral 34 denotes an actuating part of the switch. The switch 32 can be a standard low cost two position slide switch, conveniently mounted beneath the cassette bay floor 3, so that the actuating member protrudes above the cassette bay floor 3 through a slot 40. The actuating part 34 of the switch 32 is shown in a first position in FIG. 2. The cassette 10 holding 12 mm width tape has a recess 36 in its underside which is located to accommodate the actuating part 34 of the switch when it is in the first position. The switch 32 is connected to a microprocessor 39 via a connection 38 which carries a signal to the microprocessor identifying the position of the actuating member 34 of the switch. The microprocessor then uses this information to determine the width of tape which has been selected.

Figure 3:
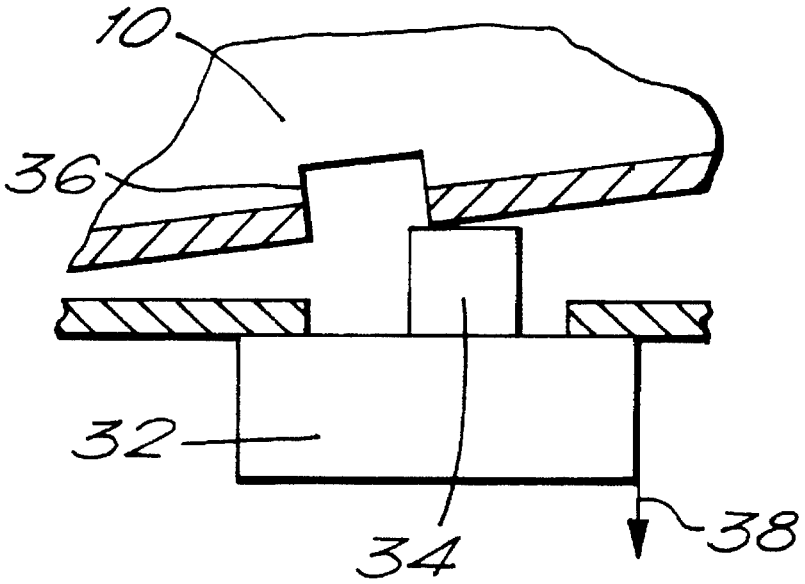

The actuating part 34 of the switch 32 is movable into a second position which is shown in FIG. 3. In the second position, it is intended to identify that a second tape width of for example 6 mm is being used. Thus, a cassette of a second type housing a tape of a width of 6 mm would have a recess located in a position to accommodate the actuating part 34 in its second position shown in FIG. 3. This is not illustrated. FIG. 3 illustrates however how the actuating member 34 of the switch 32 prevents an incorrect cassette from being inserted, with reference numeral 10 denoting a tape cassette having 12 mm tape width and a recess 36 in a location intended to accommodate the actuating member 34 in its first position.

This thus provides an effective yet cheap way of identifying the width of tape within a cassette and preventing a user from inserting an incorrect tape cassette into the machine.

What is claimed is:

1. A printing device comprising a zone for receiving a tape holding case which houses tape for printing, and a switch in said zone which is movable between at least first and second positions, wherein said zone for receiving the tape holding case is configured such that when the switch is in the first position, a tape holding case of a first type can be received in said zone without interference from the switch whereas a tape holding case of a second type cannot be received in said zone due to interference from the switch, and when the switch is in a second position, a tape holding case of the second type can be received in said zone without interference from the switch whereas a tape holding case of the first type cannot be received in said zone due to interference from the switch.

2. A printing device according to claim 1 wherein the zone comprises a tape holding case receiving bay having a surface for receiving a tape holding case.

3. A printing device according to claim 2 wherein the surface is provided with a slot and the switch has an actuating part which extends through the slot and above the surface of the tape holding case receiving bay.

4. A printing device according to claim 2 in combination with a tape holding case of either the first or second type, wherein said printing device further comprises an actuating part which extends above said surface of the tape holding case receiving bay and wherein a tape holding case of the first type holds tape of a first width and is provided with a recess in a location which will receive the actuating part of the switch when the switch is in the first position if the tape holding case is of the first type and will receive the actuating part of the switch when it is in the second position if the tape holding case is of the second type.

5. A printing device according to claim 1 which comprises a microprocessor to which the switch is connected to automatically advise the microprocessor of the type of tape holding case which has been inserted.

6. In combination, a printing device and a tape holding case, wherein said printing device comprises a zone for receiving a tape holding case which houses tape for printing, and a switch in said zone which is movable between at least first and second positions, wherein said zone for receiving the tape holding case is configured such that when the switch is in the first position, a tape holding case of a first type can be received in said zone without interference from the switch whereas a tape holding case of a second type cannot be received in said zone due to interference from the switch and, when the switch is in a second position, a tape holding case of the second type can be received in said zone without interference from the switch whereas a tape holding case of the first type can not be received in said zone due to interference from the switch and said tape holding case is one of said first and second types and is received in said tape holding case zone, without interference from the switch, said switch being in the first position, if said tape holding case is of said first type and being in said second position if said tape holding case is of said second type.

7. A printing device and tape holding case as claimed in claim 6, wherein said switch has an actuating part and said printing device has a surface for receiving said tape holding case, said actuating part of said switch extending above said surface, and said tape holding case is provided with a recess in a location which will receive the actuating part of the switch when the switch is in the first position if the tape holding case is the first type and will receive the actuating part of the switch when it is in the second position if the tape holding case is of the second type.

8. In combination, a printing device and a tape holding case, wherein said printing device comprises a zone for receiving a tape holding case and a switch movable between at least first and second positions, the switch having an actuating part which extends above a surface for receiving the tape holding case and the tape holding case has a recess in a location which when the tape holding case is in said tape holding zone will receive the actuating part of the switch when the switch is in only one of the first and second positions and not when the switch is in the other of the first and second positions.

9. In combination with a tape printing apparatus, a set of tape holding cases for use with the tape printing apparatus comprising at least two tape holding cases, wherein said tape printing apparatus includes a zone for receiving one of the tape holding cases and a switch for movable between at least first and second positions, the switch having an actuating part which extends above a surface for receiving the tape holding case, wherein said first tape holding case contains a first type of tape and has a recess in a first location for receiving the actuating part of said tape printing device only when the switch is in the first position and said second tape holding case contains a second, different, type of tape and has a recess in a location different to that of said first location of the first tape holding case for receiving the actuation part of the tape printing device only when the switch is in the second position.

* * * * *